United States Patent [19]

Richards

[11] Patent Number: 4,932,905

[45] Date of Patent: Jun. 12, 1990

[54] ELECTRICAL CONNECTOR CLIP

[75] Inventor: Edward G. Richards, Ashburton, New Zealand

[73] Assignee: Nico (No.10) Limited, Ashburton, New Zealand

[21] Appl. No.: 412,782

[22] Filed: Sep. 26, 1989

[30] Foreign Application Priority Data

Sep. 30, 1988 [NZ] New Zealand ..... 226409

[51] Int. Cl.[5] ..... H01R 13/00

[52] U.S. Cl. ..... 439/822

[58] Field of Search ..... 439/387, 822, 829

[56] References Cited

U.S. PATENT DOCUMENTS 2,762,028 9/1956 Coningh et al. ..... 439/822

3,644,877 2/1972 Carbonneau ..... 439/822

3,737,832 6/1973 Anderson ..... 439/822

*Primary Examiner*—Joseph H. McGlynn

*Attorney, Agent, or Firm*—Ross, Ross & Flavin

[57] ABSTRACT

The present invention provides an electrical connector clip comprising: two insulating body portions secured together about a pivot so as to provide handle portions at one side of the pivot and gripping portions at the other side of the pivot, said gripping portions being biassed towards each other by an electrically conducting spring mounted around the pivot and extending along said gripping portions; at least the outer end of each said gripping portion being provided with a replaceable jaw made of electrically conducting material, each said jaw being dimensioned and arranged to be in electrical contact both with said spring and with any article gripped between said gripping portions.

12 Claims, 1 Drawing Sheet

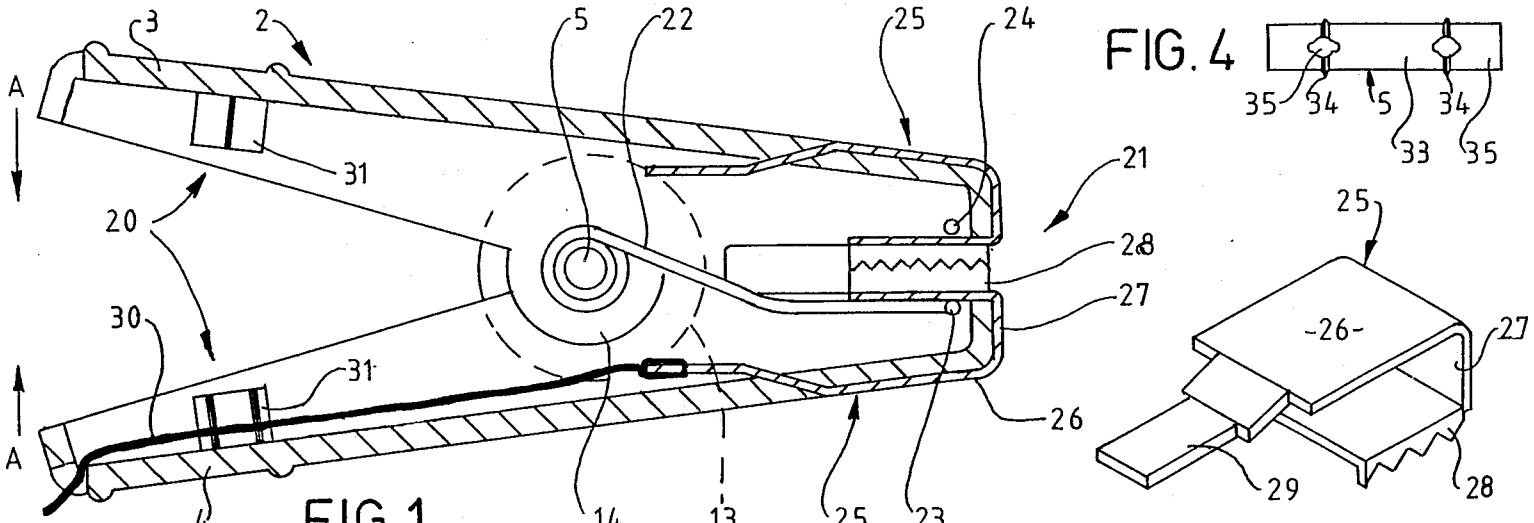
FIG. 1
FIG. 3
FIG. 4
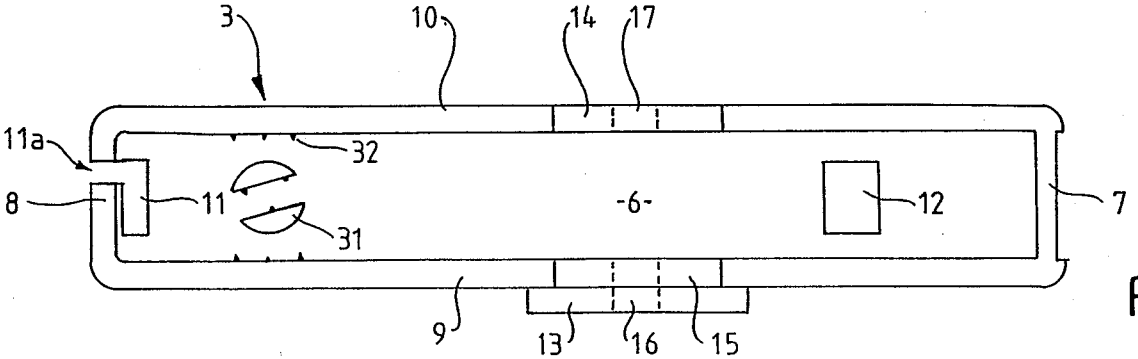
FIG. 2

ELECTRICAL CONNECTOR CLIP

BACKGROUND OF THE INVENTION (a) Field of the Invention

The present invention relates to an electrical connector clip for making a permanent or a temporary electrical connection e.g. for use as a battery terminal connector or for laboratory work.

(b) Description of the Prior Art

Electrical connector clips generally available at present are of the type disclosed in U.S. Pat. Nos. 4781629 and 4685760. These clips are made of metal, so that insulating sleeves must be fitted to allow the clips to be handled. These clips comprise two complementary body portions which are pivoted together at or near the mid-point to provide connecting jaws at one side of the pivot and handle portions at the other side of the pivot, with a spring arranged to bias the handle portions apart, and hence urge the jaws together. To open the jaws, the handle portions are pressed together against the bias of the spring. This type of construction has two major drawbacks: firstly, the positioning of the spring places considerable stress on the pivot, and makes the clip comparatively hard to operate, because spring pressure is applied to the jaws only indirectly. Secondly, most of the wear on the clip is on the jaws, but since these are formed integrally with the rest of the clip, the whole clip must be replaced when the jaws wear out.

An object of the present invention is the provision of a clip which overcomes the above-described disadvantages.

BRIEF SUMMARY OF THE INVENTION

The present invention provides an electrical connector clip comprising: two insulating body portions secured together about a pivot so as to provide handle portions at one side of the pivot and gripping portions at the other side of the pivot, said gripping portions being biassed towards each other by an electrically conducting spring mounted around the pivot and extending along said gripping portions; at least the outer end of each said gripping portion being provided with a replaceable jaw made of electrically conducting material, each said jaw being dimensioned and arranged to be in electrical contact both with said spring and with any article gripped between said gripping portions.

BRIEF DESCRIPTION OF THE DRAWINGS

By way of example only, a preferred embodiment of the present invention is described in detail with reference to the accompanying drawings, in which:

FIG. 1 is a longitudinal section through a clip of the present invention;

FIG. 2 is a plan view of one-half of the body of the clip of FIG. 1;

FIG. 3 is an isometric view of one of the replaceable jaws of the clip of FIG. 1; and FIG. 4 is a side view of the pivot pin.

DETAILED DESCRIPTION OF THE PREFERRED EMBODIMENT

Referring to the drawings, a clip 2 comprises two identical body portions 3, 4, which are pivoted together by a pivot pin 5. Each body portion 3, 4, is made of a rigid insulating material (e.g. a rigid plastics material) and comprises a rectangular base 6 formed with a peripheral rim which forms end walls 7, 8, and side walls

9, 10, all substantially perpendicular to the plane of the base. An aperture 11 is formed through the base 6 adjacent the rear end wall 8; one end of said aperture 11 opens into an aperture 11*a*formed through said wall 8. A second aperture 12 is formed through the base 6 between the front end wall 7 and the point at which the body portions are pivoted together.

Two circular bosses 13, 14 are formed one on each side wall 9, 10. On side wall 9, a large boss 13 is formed, with the inner face of the boss contiguous with the outer face of the wall 9, and a part-circular socket 15 is formed in said wall 9, concentric with said boss 13. On the opposite side wall 10, a small boss 14 is formed, in the plane of the wall 10 and opposite the boss 13 so that the centres of said bosses are coaxial. The bosses 13, 14, lie in planes parallel to each other and to the plane of the side walls 9 and 10. A hole 16, 17, is formed through the centre of each boss 13, 14.

When the two body portions are joined together, the bosses 13, 14 on each body portion are arranged with the boss 13 of each body portion lying on the outside of, but parallel to, the boss 14 of the other body portion, and the boss 14 of each portion lying in the socket 15 of the other portion. The pivot pin 5 extends through the aligned holes 16, 17, and is secured in known manner, fastening the two body portions pivotally together.

The pivot pin 5 may be of any suitable known type, but preferably is as shown in FIG. 4, and comprises a generally cylindrical pin 33 formed with two spaced pairs of projections 34 on the outer surface thereof, and two cut-outs 35 through the pin, each centered on one of the pairs of projections 34. Each pair of projections 34 is positioned so as to lie against the inner wall of the corresponding boss 14.

When the clip is being assembled the cut-outs 35 allow the pin 5 to compress sufficiently to allow the pin to be push-fitted through the holes 16, 17, but once in place the pin 5 springs back into its original shape, and the pairs of projections 34 prevent the pin from sliding sideways out of the holes 16, 17.

The bosses 13, 14 are formed about 5/8 along the length of the respective body portions, forming a clip with a relatively long handle 20 and a relatively short gripping end 21. However, it will be appreciated that these proportions may be varied as required, for different applications.

A spring 22 is mounted on the pin 5, and is arranged to bias the gripping end of the clip towards the closed position shown in FIG. 1.

The spring 22 comprises a coil spring mounted coaxially upon the pin 5, the spring 22 being formed with elongated ends 23, 24 which extend towards the front end of the clip and are bent through 90° to form a foot which lies against, or adjacent, the respective front end walls 7. One end 23 extends from the spring 22 diagonally across the front end of the clip to one end wall 7, and the other end extends from the spring 22 diagonally across the front end of the clip to the other end wall 7. Thus, the spring 22 tends to urge the halves of the front end of the clip together; pressure in the direction of arrows A on the handle end of the clip will tend to overcome the spring pressure and force the halves of the gripping end of the clip apart.

A metal replaceable jaw 25 is fitted over each wall 7 of the clip. Each jaw 25 is as shown in FIG. 3 and comprises a generally U-cross-section portion, dimensioned to fit over the end wall 7 of each body portion with a first part 26 lying on the outer surface of the base 6, a second part 27 lying over the outer surface of the front end wall 7, and a third part 28 parallel to said first part, lying on the interior of the clip and serrated to form two parallel gripping surfaces. The serrations of the opposed parts 28 are complementary, and the jaws may be proportioned so that the serrations mesh with each other when the jaws are closed, or may be proportioned so that the gripping surfaces on one jaw are staggered relative to the gripping surfaces on the other jaw, thus giving the jaws four separate areas of electrical contact with an article gripped between the jaws.

An elongated part 29 is formed integrally with the first part 26, and extends through the aperture 12 in the base 6, terminating in the interior of the clip. To make an electrical connection to the jaws 25, a wire 30 terminating in a connector of known type (e.g. a spade connector) is connected to the free end of the part 29. The wire 30 is led into the interior of the clip through apertures 11/11*a*, and is gripped either between the sides of an apertured boss 31 formed integrally with the interior wall of the base 6, or between the exterior of said boss 31 and projections 32 formed on the adjacent side walls 9, 10, depending upon the diameter of the wire.

Since the spring 22 is made of metal, and the ends 23, 24, of the spring contact the parts 28 of the jaws, the spring provides an electrical connection between the two jaws, ensuring an even electrical connection between the wire 30 and any object gripped between the jaws.

It will be appreciated that the jaws 25 may be quickly and easily replaced when they become worn, and different styles of jaws may be substituted as needed for particular applications. It is also envisaged that the jaws may be designed with the part 28 pivoted to the remainder of the jaw, to allow improved electrical contact between the jaws and articles of rectangular cross-section.

In the design of the present invention, the jaws 25 are positively urged together by the spring, rather than being urged together by the spring urging the handle portions apart. This minimises the force required to open the clip, and also minimises the forces on the pivot pin 5.

It is envisaged that each body portion could be made double-ended i.e. with the apertures 11 and 12 formed at each end of the clip, so that the same body and jaw components could be assembled to form a clip with a longer or shorter gripping end, simply by using a longer or shorter spring on the longer or shorter side of the body portions, as appropriate.

The clip body portions are at all times fully insulated, and may be manufactured in a wide range of colours, so that different electrical connections can be easily identified. In the prefered embodiment the body portions are identical, so tooling costs are minimised. However, if tooling costs are not a major consideration, the body portions need not be identical.

It is also envisaged that, for some applications, it would be advantageous to have the outside of the clip completely insulated, and for such applications the jaws 25 may be constructed so as to lie entirely within the corresponding body portion.

I claim:

1. An electrical connector clip comprising: two insulating body portions secured together about a pivot so as to provide handle portions at one side of the pivot and gripping portions at the other side of the pivot, said gripping portions being biassed towards each other by an electrically conducting spring mounted around the pivot and extending along said gripping portions; at least the outer end of each said gripping portion being provided with a replaceable jaw made of electrically conducting material, each said jaw being dimensioned and arranged to be in electrical contact both with said spring and with any article gripped between said gripping portions.

2. The clip as claimed in claim 1, wherein each body portion is substantially rectangular in plan and each of the longer sides of said rectangle is provided with a boss which lies in a plane substantially perpendicular to the plane of said body portion; both said bosses being co-axial and apertured to receive said pivot therethrough.

3. The clip as claimed in claim 1 wherein each said body portion is shaped so as to permit either end of said body portion being used as either the handle portion or the gripping portion.

4. The clip as claimed in claim 2 wherein both said body portions are identical.

5. The clip as claimed in claim 4, wherein each body portion is formed with a peripheral rim which provides side walls along the longer sides of said rectangle, and end walls along the shorter sides of said rectangle; one of said side walls having a first boss formed thereon, co-planar with said side wall, and the other of said side walls having a part-circular socket formed therein, of the same radius of curvature as said first boss; and a second boss having a larger radius of curvature than said first boss being formed adjacent said other side wall; said first and second bosses and said socket all being co-axial, such that when the two body portions are assembled to form a clip, the first boss of each body portion is received into the socket of the other body portion, the two second bosses lie one on each outer side of the clip, and a pivot pin extends through the aligned apertures in said first and second bosses.

6. The clip as claimed in any preceding claim wherein each jaw is U-shaped in cross-section and is a press-fit over the end of the corresponding gripping portion, each said jaw providing a serrated portion arranged to lie between the opposed gripping portions of the clip.

7. The clip as claimed in claim 6 wherein part of each jaw passes into the interior of the clip through a slot formed in the corresponding body portion, and is secured to connection means for providing an electrical connection between said jaw and a wire to be connected to the clip.

8. The clip as claimed in claim 6 wherein each jaw provides at least two spaced serrated portions.

9. The clip as claimed in claim 8 wherein the serrated portions on one jaw are staggered relative to the serrated portions on the other jaw.

10. The clip as claimed in claim 6 wherein the serrated portion of each jaw is pivoted to said jaw.

11. The clip as claimed in claim 1 wherein each body portion provides securing means for securing to said body portion a wire to be electrically connected to said clip.

12. The clip as claimed in claim 4 wherein said pivot pin comprises a generally cylindrical pin dimensioned to be a push-fit into said apertures, and formed with spaced projections on the exterior surface thereof to engage the side walls of the body portions and prevent the pin from sliding out of engagement therewith; said pin also being formed with cut-out portions in the interior thereof, aligned with said projections, to allow the pin to contract radially during assembly of the clip.

* * * * *